US008647140B2

(12) United States Patent
Annecke

(10) Patent No.: US 8,647,140 B2
(45) Date of Patent: Feb. 11, 2014

(54) ELECTRICAL PLUG-IN CONNECTOR AND ELECTRICAL CONNECTION SYSTEM

(75) Inventor: Alfred Annecke, Heilbronn (DE)

(73) Assignee: Amphenol-Tuchel Electronics GmbH, Heilbronn (DE)

( * ) Notice: Subject to any disclaimer, the term of this patent is extended or adjusted under 35 U.S.C. 154(b) by 80 days.

(21) Appl. No.: 13/459,218

(22) Filed: Apr. 29, 2012

(65) Prior Publication Data

US 2012/0309218 A1 Dec. 6, 2012

(30) Foreign Application Priority Data

May 31, 2011 (DE) ..... 10 2011 050 773

(51) Int. Cl.
*H01R 13/627* (2006.01)

(52) U.S. Cl.
USPC ..... 439/352; 439/362

(58) Field of Classification Search
USPC ..... 439/352, 351, 353, 764, 362
See application file for complete search history.

(56) References Cited

U.S. PATENT DOCUMENTS 5,616,045 A * 4/1997 Gauker ..... 439/352
5,688,141 A * 11/1997 Dullin ..... 439/352
5,746,618 A * 5/1998 Gauker ..... 439/352
5,924,885 A * 7/1999 Pacher ..... 439/352
6,319,042 B2 * 11/2001 Hirschmann ..... 439/352
6,435,894 B2 * 8/2002 Little et al. ..... 439/352
6,811,424 B2 * 11/2004 Seminara et al. ..... 439/352
6,997,750 B2 * 2/2006 Johannes et al. ..... 439/620.05
7,131,854 B1 11/2006 Pavlovic et al.
7,578,694 B2 * 8/2009 Takahashi et al. ..... 439/352

FOREIGN PATENT DOCUMENTS

DE 102 30 465 B3 1/2004
DE 10 2005 007 066 B3 10/2006
DE 202 21 894 U1 3/2009
EP 1 253 680 A1 10/2002

* cited by examiner

*Primary Examiner* — Hae Moon Hyeon
(74) *Attorney, Agent, or Firm* — Smartpat PLC; Axel Nix

(57) ABSTRACT

An electrical plug-in connector/an electrical connection system is used between a socket of an igniter module and an electronic control unit for a restraint system in motor vehicles. The plug-in connector comprises a housing with one or more locking arms for locking the housing to the socket. The locking arms reinforce the lock mechanism when a force is applied to pull the plug-in connector from the socket without actuating the locking arms. Alternatively, the plug-in connector/connection system comprises a housing with one or more locking arms that are selectable between a locking position and an unlocking position. The locking arms are at least partially elastic, and serve to lock the housing to the socket. When a force is applied to pull the plug-in connector from the socket, the locking arms are locking when in the locking position and releasably snapping when in the unlocking position.

16 Claims, 2 Drawing Sheets

ELECTRICAL PLUG-IN CONNECTOR AND ELECTRICAL CONNECTION SYSTEM

TECHNICAL FIELD

The present disclosure relates to an electrical plug-in connector and an electrical connection system for use between a socket of an igniter module and an electronic control unit for a restraint system in a motor vehicle.

BACKGROUND

Electrical plug-in connectors used between igniter modules and electronic control units in motor vehicles have to meet extremely high safety requirements with regard to plug-in safety and contact safety. Both plug-in safety and contact safety have to be ensured for a long period of time and under partly extreme conditions such as vibrations and severe temperature fluctuations.

At the same time, such plug-in connectors have to be ever cheaper, lighter, smaller, and easier to assemble. An intuitive operation of the unlocking should be provided when being unlocked, preferably without the need for tools.

Additional requirements include low insertion force with distinct acoustic and/or tactile feedback during plugging in, an indication of the condition of the plug, and a geometric shape that provides the maximum safety against external interference.

SUMMARY

A disclosed plug-in connector/connection system provides an improved solution to the aforementioned technical problems, especially tailored to standard sockets.

The improved electrical plug-in connector for use between a socket of an igniter module and an electronic control unit for a restraint system in a motor vehicle comprises a housing, and one or more locking arms for releasably locking the housing to a socket. The plug-in connector and the corresponding socket form an electrical connection system. The housing engages the socket along an insertion direction S. The one or more locking arms can be actuated to unlock the housing from the socket. Without actuation the one or more locking arms reinforce a lock between the housing and the socket when an attempt is made to pull the housing out of the socket. The one or more locking arms may be at least partially elastic, so as to assume a default position and create an elastic spring force when deformed.

The disclosed connector eliminates the need for a secondary locking mechanism. Instead, one or more locking arms are located on the housing of the plug-in connector and arranged such, that inadvertent releasing of the plug-in connector from the socket without actuation of the one or more locking arms is made impossible. More specifically, if the one or more locking arms are in their locking position, their geometric shape causes the engagement between the housing, respectively the locking arm disposed thereon, and the socket to be reinforced (locked). The engagement of the locking arm in the socket, and more specifically the engagement of a latch projection of the locking arm into a latch recess of the socket, is reinforced to such an extent that disconnection of the plug-in connector without actuation of the locking arm is impossible, except through destruction. The disclosed electrical plug-in connector is designed to be self-locking, i.e. the locking arm has be to actively actuated to unlock, and defaults to a locked state. By pulling the locked plug-in connector against the insertion direction S, i.e. by applying a pull force K, the one or more locking arms provide a counter-acting retention force, which increases with increasing pull force until the housing and/or the electrical plug-in connector is destroyed. The self-locking effect of the connector may be disabled by actuation of the one or more locking arms at least to the degree that it is possible to unplug the plug-in connector from the socket of the igniter.

The disclosed plug-in connector meets its requirements by a defined interaction with the socket of the igniter, which may be a standardized socket.

Advantageously, the electrical plug-in connector may be configured such that upon actuation of the one of more locking arms the lock between the locking arm and the socket is not completely released, i.e. the retention force (latching force) is not reduced to zero. Rather, actuation of the locking arm overcomes the reinforcing effect of locking arm against pulling the connector from the socket, but maintains a limited retention force which acts as a removable snap. To release the electrical plug-in connector from the socket the locking arm has hence to be actuated to overcome its reinforcing, self-locking, characteristic. A limited pull force has to then be applied to overcome the remaining (non self-reinforcing) snap force. The snap force may be established by a spring action of the locking arm, preferably by elastic deformation of the locking arm. It is especially advantageous if the locking arm comprises a latch section, and two elastic spring sections. A longer upper spring section is disposed above the latch section, and a shorter lower spring section is disposed below the latch section of the locking arm. The locking arm may then deform against an elastic force by bending the upper and the lower spring sections of the locking arm inward, thus moving the latch section away from a corresponding latch recess of the socket. This allows a space-saving geometric shape which can be applied to standard sockets. Also, the self-locking (reinforcing) effect of the locking arm is realized in an especially simple and space-saving way.

The self-locking effect of the locking arm is especially effective if the latching of the locking arm is effected by the locking arm engaging the socket crosswise to the insertion direction S.

The locking arm may be actuable between two stops, an inner stop and an outer stop. The inner stop and the outer stop may be located opposite each other and crosswise to the insertion direction. They are preferably molded onto the cover and establish a locking position and an unlocking position of the locking arm. Such a geometric shape is surprisingly effective, safe, and viable in terms of space-saving without signs of fatigue arising through long-term use, for example, through creeping of the plastic material.

The locking arm preferably has a radially convex cross section when in a plugged-in state. This provides the desired self-reinforcing lock effect of the plug-in connector to the socket with an optimal distribution of force along the locking arm. It is therefore guaranteed, that the locking arm, depending on the geometric shape and condition, applies a very high maximum counteracting force until destruction of the locking arm and/or the plug-in connector.

The latch section of the locking arm may comprise a rounded latch projection, which causes a distinct acoustic and tactile feedback when plugging the connector into the socket. At the same time such a configuration can achieve space-saving and compatibility with standard sockets.

Advantageously, the plug-in connector comprises a cover, which may be clipped to the housing. In this way the electrical plug-in connector can be designed of two plastic components, namely the cover and a plug-in body featuring the one or more locking arms. Thereby manufacturing costs are reduced, since only two plastic components are to be designed. This implies a reduction in the number of components and a cost saving.

The length F of the lower spring section of the locking arm is preferably less than one third, and especially less than one quarter, of the height of the locking arm. By these dimensions the spring section is stable, and the locking function of the locking arm is guaranteed.

The disclosed connector may eliminate the need for a secondary locking mechanism. Therefore, the opening of a short-circuit jumper can be integrated with significantly more ease, since the kinematics of the plug-in connector are designed much more simply than with a plug-in connector with a secondary locking mechanism.

The disclosed plug-in connector and corresponding socket form an electrical connection system suitable for use between an igniter module and an electronic control unit for a restraint system in motor vehicles.

The following detailed description is merely exemplary in nature and is not intended to limit the invention or the application and uses of the invention. Furthermore, there is no intention to be bound by any theory presented in the preceding background or the following detailed description.

Figure 1B:
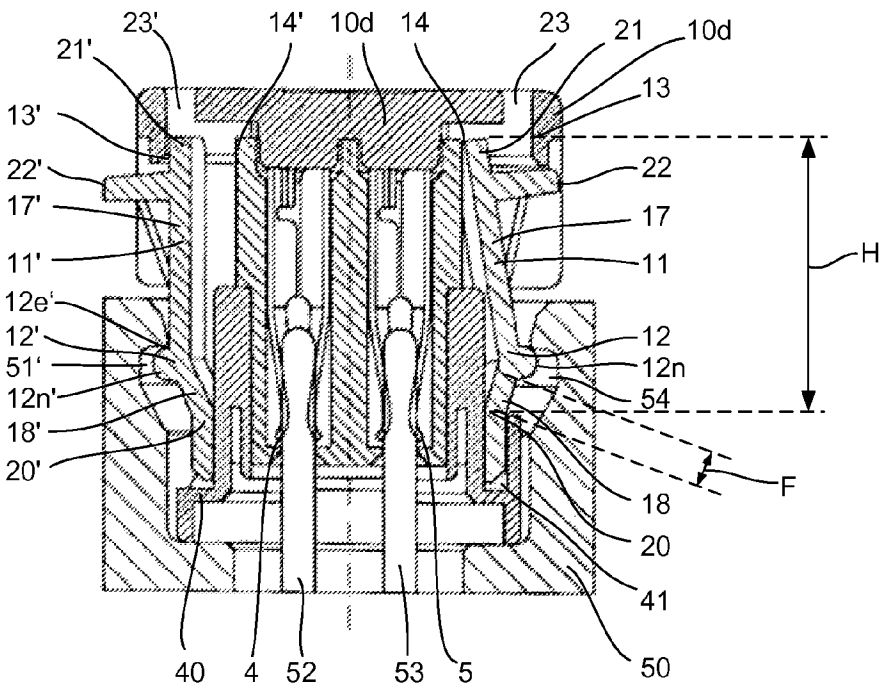
FIG. 1*b* a cross-sectional view of the plug-in connector with an actuated right and a non-actuated left locking arm in a socket according to a second embodiment.

In the figures similar or identical components are marked with the same reference signs.

DETAILED DESCRIPTION

Referring to FIG. 1 through 5, an electrical plug-in connector (1) comprises a plug-in body (10*s*) and a cover (10*d*) that can be clipped onto the plug-in body (10*s*) using clips (15, 16). The plug-in body (10*s*) and the cover (10*d*) jointly form a housing (10). Two wires (2, 3) are fed into the housing (10) and are connected to terminals (4, 5) inside the housing (10). The housing (10) is preferably L-shaped. The terminals (4, 5) are disposed parallel to each other and extend in the insertion direction S. The terminals (4, 5) serve to provide electrical contact between the electrical plug-in connector (1) and two corresponding plug-in contacts (52, 53) of the socket (50).

The plug-in body (10*s*) comprises locking arms (11, 11') for locking the electrical plug-in connector (1) to the socket (50). The locking arms (11, 11') are disposed laterally opposite each other at a cylindrical hosing wall (19) where the electrical plug-in connector (1) engages the socket (50). The locking arms (11, 11') comprise latch sections (12, 12') with latch projections (12*n*, 12*n*'), which engage corresponding latch recesses (51, 51') of the socket (50). As shown in FIG. 1, latch recess (51, 51') may be formed as a latch groove (54) extending circumferentially along the inside of the socket (50). The latch sections (12, 12') are disposed between shorter lower spring sections (18, 18') and longer upper spring sections (17, 17') of the locking arms (11, 11').

Figure 3:
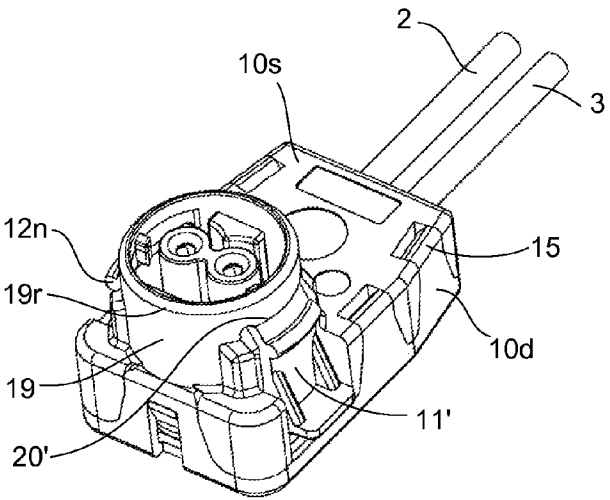
FIG. 3 is a perspective view of the plug-in connector.

As shown in FIG. 3, the plug-in connector (1) may consist of only a housing (10), which consists of a plug-in body (10*s*) and a cover (10*d*), and terminals (4, 5) which are connected to wires (2, 3). The plug-in body (10*s*) is formed to match the opening of socket (50), and comprises an essentially cylindrical housing wall (19). The locking arms (11, 11') are formed as an integral part of the plug-in body (10*s*), extending laterally from the lower end of the housing wall (19) of the plug-in body (10*s*). The lower ends (20, 20') of the locking arms (11, 11') extend into the housing wall (19).

Grips (22, 22') for operating the locking arms (11, 11') are disposed at the upper (free) ends (21, 21') of the locking arms (11, 11') opposite their lower ends (20, 20'). The grips (22, 22') may be formed as integral parts of the locking arms (11, 11') and protrude laterally from the housing (10) when the locking arms (11, 11') are in a non-actuated (locked) state. An operator can push the grips (22, 22') inward and thereby actuate the locking arms (11, 11') by elastically deforming at least their respective lower spring sections (18, 18').

The lower end of the housing wall (19) is formed as a peripherally closed ring portion (19*r*). When plugged into the socket (50), the housing wall (19) immerses in a pocket (41) which is provided at least in portions on the perimeter of an insulation ring (40) of the socket (50). Consequently, at least one of the lower ends (20, 20'), especially directly above the insulation ring (40), is firmly secured in the socket (50). The depth of the pocket (41) and/or the projection depth of the lower ends (20, 20') into the pocket (41) hence determine the kinematics of the elastic upper spring sections (17, 17') and elastic lower spring sections (18, 18') of the locking arms (11, 11'). The lower spring sections (18, 18') have a length F, extending from the upper end of the pocket (41) to the locking arm's latch sections (12, 12').

The lower spring sections (18, 18') of the locking arms (11, 11') are angled outwardly in the direction of the latch recess (51, 51') of the socket (50), at an angle greater than 5°, preferably greater than 10°, more preferably greater than 20°.

The plugged-in and locked state of the electrical plug-in connector (1) is shown in FIG. 1 by the non-actuated left locking arm (11') in the socket (50). The locking arm (11') is in the locking position so that the plug-in connector (1) cannot be pulled out. An outer stop (13') on the cover (10*d*) is provided to define the locking position of the locking arm (11'). The upper end (21') of the locking arm (11') rest against the outer stop (13') of the cover (10*d*) pretensioned by the spring effect of its lower spring section (18').

To achieve the desired self-locking effect, at least one of the locking arms (11, 11'), and preferably both locking arms as shown, feature a geometric shape which is based on the bending beam principle. The locking arms (11, 11') are secured at their lower ends (20, 20') and function as bending beams. Each bending beam comprises a lower fixed bearing and an upper movable slide bearing. As shown in FIG. 1, the right locking arm (11) is actuated and its upper end (21) is pushed against the inner stop (14) of the cover (10*d*). The upper end (21) of the actuated locking arm (11) cannot be pushed inward past the inner stop (14). It hence maintains another bearing, namely a slide bearing, and works according to the principle of a curved bending beam. The actuated locking arm (11) is bent through to the outside and snaps underneath the latch projection (12*n*) into the latch recess (51) of the socket (50). If the plug-in connector (1) is pulled against the insertion direction S, then the actuated locking arm (11) can be bent inward and the upper end (21) of the actuated locking arm (11) can slide upward along the respective inner stop (14). This allows the latch projection (12*n*) to slide past the socket's latch recess (51) as the plug-in connector (1) is pulled out of the socket (50). In the actuated state the locking arm (11) functions according to the bending beam principle.

In contrast, the non-actuated locking arm (11') is in a self-locking state, in which the latch projection (12*n*') engages the latch recess (51') of the socket (50) so as to irremovably lock the plug-in connector (1) into the socket (50). The lower end (20') of the locking arm (11') is inserted and secured in the pocket (41) of the insulation ring (40) at least crosswise to the insertion direction S. Alternatively, the pocket (41) might be part of the socket (50) (not shown).

The latch section (12') of the non-actuated locking arm (11') engages the latch recess (51') of the socket (50) such, that an edge (12*e*') of the latch projection (12*n*') touches a corresponding internal upper edge (51*u*') of the latch recess (51'). In this state, a pull force K that may be applied against the insertion direction S to the housing (10) or to the electric plug-in connector (1), possibly at an angle, is transferred through the locking arm (11') without disengaging from the socket (50). The higher the pull force K, the stronger the corresponding retention force. At the same time the spring section (17') of the locking arm (11') curves towards the interior of the plug-in connector (1) and thereby further increases the retention force.

The plug-in connector (1) can only be unplugged from the socket (50) upon actuation of the locking arm (11, 11') into the unlocking position, as shown in the right locking arm (11) in FIG. 1. The unlocking position is defined by an inner stop (14, 14') which is located opposite the respective outer stop (13, 13') on the cover (10*d*). The actuation is effected by grips (22, 22') protruding laterally from the housing (10). The locking position can be shown and controlled through a cut-out (23, 23') in the cover (10*d*).

In the unlocking position the locking arm (11) is curved radially outward, leaving the latch projection (12*n*) partially engage in the latch recess (51). The latch projection (12*n*) can be pushed inward to unsnap the connector (1) from the socket (50) by pulling the connector (1) against its insertion direction S. In that case, the latch projection (12*n*) is pushed against a spring force. The spring force is created by the upper spring section (17) above the latch projection (12*n*) and the lower spring section (18) below the latch projection (12*n*) of the locking arm (11). The upper spring section (17) is longer than the lower spring section (18). The lower spring section (18) is responsible for the locking.

Figure 1A:
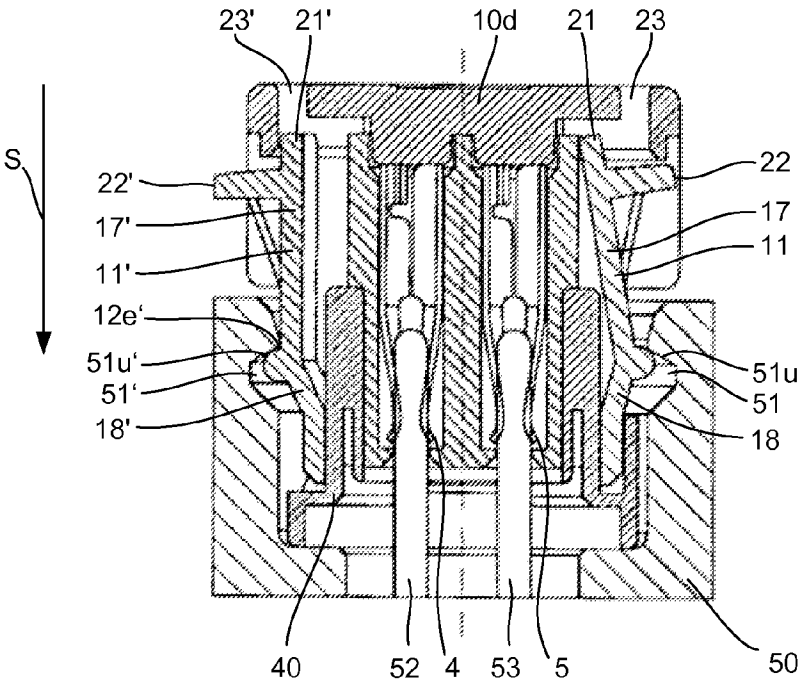
FIG. 1*a* is a cross-sectional view of a plug-in connector with an actuated right and a non-actuated left locking arm in a socket according to a first embodiment.
Figure 2:
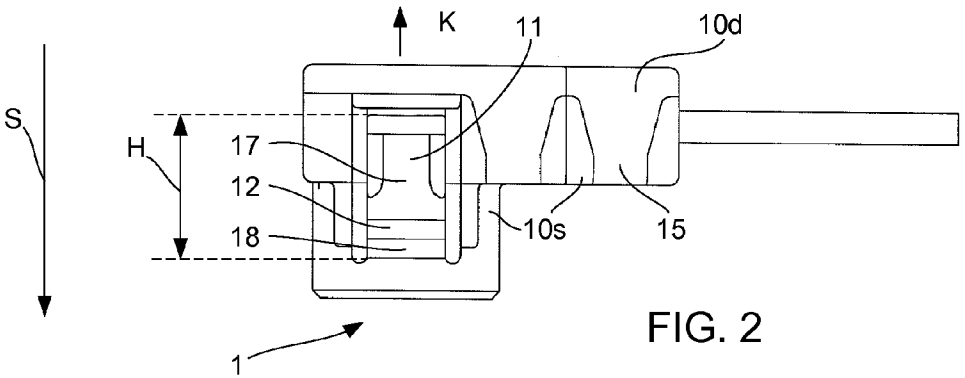
FIG. 2 is a side view of the plug-in connector.
Figure 5:
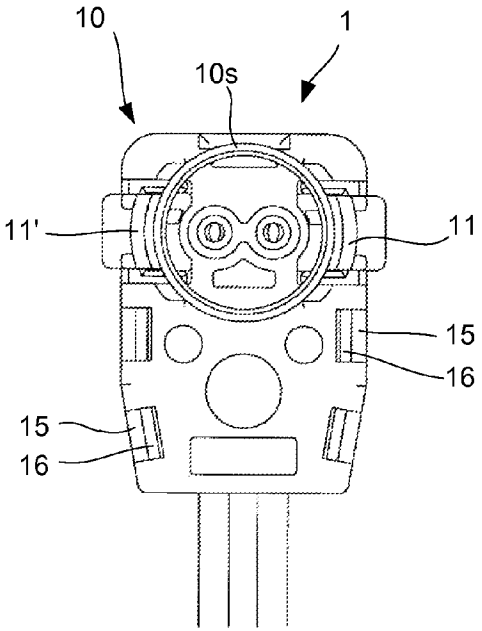
FIG. 5 is a bottom view of the plug-in connector.
Figure 4:
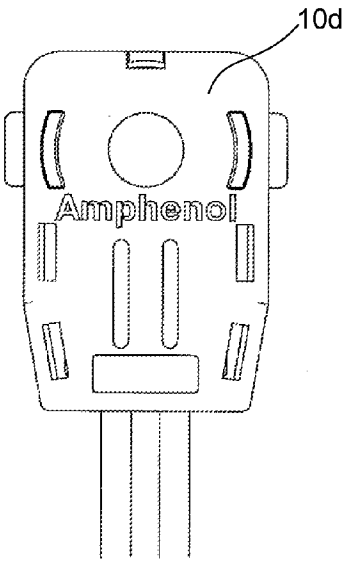
FIG. 4 is a top view of the plug-in connector.

Alternative embodiments of the latch groove (54) of the socket (50) are shown in FIG. 1*a* and FIG. 1*b*. As shown in FIG. 1*a*, the internal upper edge (51*u*, 51*u*') of the latching groove (54) may be tapered, so that the snapping force for releasing the locking arm (11, 11') in the unlocking position is low.

In the embodiment according to FIG. 1*b*, the internal upper edge (51*u*, 51*u*') of the latching groove (54) extends crosswise to the insertion direction S, so that the lock is safer, but unsnapping the connector (1) is more difficult than in the embodiment shown in FIG. 1*a*.

A defined snap point arises especially as a result of the semi-circular arrangement of the latch projections (12*n*, 12*n*') in cross section.

While the present invention has been described with reference to exemplary embodiments, it will be readily apparent to those skilled in the art that the invention is not limited to the disclosed or illustrated embodiments but, on the contrary, is intended to cover numerous other modifications, substitutions, variations and broad equivalent arrangements that are included within the spirit and scope of the following claims.

What is claimed is:

1. An electrical plug-in connector for use between a socket of an igniter module and an electronic control unit for a restraint system in a motor vehicle, comprising:

a housing having one or more locking arms for releasably locking the housing to the socket when the housing engages the socket along an insertion direction (S), wherein the one or more locking arms can be actuated to unlock the housing from the socket, and wherein the one or more locking arms reinforce a lock between the housing and the socket when the housing is pulled from the socket without actuating the one or more locking arms to unlock the housing from the socket, and wherein the one or more locking arms comprise an elastic lower spring section and a latch section above the lower spring section, the latch section being configured to engage a corresponding latch recess of the socket and disposed at an angle relative to the insertion direction (S) extending outwardly towards the latch recess of the socket, and wherein the one or more locking arms are secured at their lower ends by projecting into a pocket of an insulation ring which is inserted into the socket.

2. The electrical plug-in connector is in claim 1, wherein the one or more locking arms engage the latch recess of the socket crosswise to insertion direction (S), thereby locking the connector to the socket.

3. The electrical plug-in connector as in claim 1, wherein the one or more locking arms have a radially convex cross section when in their unlocking position.

4. The electrical plug-in connector as in claim 1, wherein the latch section comprises a rounded latch projection.

5. The electrical plug-in connector as in claim 1, wherein the lower spring section has a length (F) which is less than a third of a height (H) of the one or more locking arms.

6. The electrical plug-in connector as in claim 1, wherein the lower spring section has a length (F) which is less than a quarter of a height (H) of the one or more locking arms.

7. An electrical connection system comprising the plug-in connector as in claim 1 and the socket with a corresponding latch recess.

8. An electrical plug-in connector for use between a socket of an igniter module and an electronic control unit for a restraint system in a motor vehicle, comprising:

a housing having one or more locking arms for releasably locking the housing to the socket, the one or more locking arms being configured to assume a default locking position and operable to be pushed against an elastic force into an unlocking position for disengaging the connector from the socket, wherein the one or more locking arms irremovably lock the housing in the socket when the one or more locking arms are in the locking position, and wherein the one or more locking arms removably snap the housing in the socket when the one or more locking arms are in the unlocking position, and wherein the one or more locking arms comprise upper spring sections, lower spring sections, and latch sections disposed between the upper spring sections and the lower spring sections, the latch sections being configured to engage corresponding latch recesses of the socket and disposed at an angle relative to insertion direction (S) extending outwardly towards the latch recesses of the socket, and wherein the one or more locking arms are fixed at their lower ends by projecting into a pocket of an insulation ring which is inserted into the socket.

9. The electrical plug-in connector is in claim 8, wherein the one or more locking arms engage the socket crosswise to insertion direction (S), thereby locking the connector to the socket.

10. The electrical plug-in connector as in claim 8, further comprising a cover disposed on top of the housing, wherein the one or more locking arms are operable between the default locking position and the unlocking position, and wherein the default locking position is defined by an outer stop and the unlocking position is defined by an inner stop.

11. The electrical plug-in connector as in claim 10, wherein the inner stop or the outer stop or both the inner stop and the outer stop are molded onto the cover.

12. The electrical plug-in connector as in claim 8, wherein the one or more locking arms have a radially convex cross section when in their unlocking positions.

13. The electrical plug-in connector as in claim 8, wherein the latch sections comprise rounded latch projections.

14. The electrical plug-in connector as in claim 8, wherein the lower spring sections have a length (F) which is less than a third of a height (H) of the one or more locking arms.

15. The electrical plug-in connector as in claim 8, wherein the lower spring sections have a length (F) which is less than a quarter of a height H of the one or more locking arms.

16. An electrical connection system comprising the plug-in connector as in claim 8 and the socket with a corresponding latch recess.

* * * * *